US011199195B2

(12) United States Patent
Capron

(10) Patent No.: US 11,199,195 B2
(45) Date of Patent: Dec. 14, 2021

(54) SHROUD WITH CONTINUOUS SLOT AND ANGLED BRIDGES

(71) Applicant: PRATT & WHITNEY CANADA CORP., Longueuil (CA)

(72) Inventor: Alexandre Capron, Toronto (CA)

(73) Assignee: PRATT & WHITNEY CANADA CORP., Longueuil (CA)

( * ) Notice: Subject to any disclaimer, the term of this patent is extended or adjusted under 35 U.S.C. 154(b) by 66 days.

(21) Appl. No.: 16/657,095

(22) Filed: Oct. 18, 2019

(65) Prior Publication Data

US 2021/0115936 A1 Apr. 22, 2021

(51) Int. Cl.
*F04D 27/02* (2006.01)
*F04D 17/10* (2006.01)

(52) U.S. Cl.
CPC ..... *F04D 27/0207* (2013.01); *F04D 17/10* (2013.01)

(58) Field of Classification Search
CPC .. F04D 27/0207; F04D 17/10; F04D 29/4206; F02C 3/08; F02C 6/08; F01D 9/026; F01D 9/06; F01D 9/065; F01D 11/02; F01D 11/08; F01D 17/105; F05D 2260/606
USPC ..... 415/1, 115, 116, 169.1, 173.1; 60/782, 60/785
See application file for complete search history.

(56) References Cited

U.S. PATENT DOCUMENTS

| | | | | |
|---|---|---|---|---|
| 4,248,566 | A * | 2/1981 | Chapman | F04D 27/0215 415/26 |
| 6,183,195 | B1 * | 2/2001 | Tremaine | F04D 29/4213 415/1 |
| 8,105,012 | B2 | 1/2012 | Anema | |
| 8,490,408 | B2 * | 7/2013 | Nichols | F01D 25/28 60/782 |
| 8,935,926 | B2 * | 1/2015 | Wagner | F04D 29/286 60/785 |
| 9,650,916 | B2 * | 5/2017 | Barton | F04D 29/4206 |
| 2016/0090840 | A1 * | 3/2016 | Watkin | F01D 9/04 415/209.3 |
| 2017/0211586 | A1 * | 7/2017 | Gage | F04D 29/582 |
| 2017/0298777 | A1 * | 10/2017 | Lamusga | F01D 9/02 |

* cited by examiner

*Primary Examiner* — Thai Ba Trieu
(74) *Attorney, Agent, or Firm* — Norton Rose Fulbright Canada LLP

(57) ABSTRACT

A shroud configured to be disposed around an impeller of a centrifugal compressor, the shroud has a wall extending around a central axis of the centrifugal compressor, the wall having an inner face oriented toward a gaspath and an outer face oriented away from the gaspath, a slot extending all around the central axis and from the inner face to the outer face of the wall, bridges secured to the wall, the bridges circumferentially distributed around the central axis and spanning across the slot, the bridges extending from roots to tips, the tips of the bridges circumferentially offset from the roots relative to the central axis.

20 Claims, 4 Drawing Sheets

SHROUD WITH CONTINUOUS SLOT AND ANGLED BRIDGES

TECHNICAL FIELD

The application relates generally to gas turbine engines and, more particularly, to bleed features suited for use in impeller shrouds.

BACKGROUND OF THE ART

Engine air systems of gas turbine engines may require extraction of compressed air to support, for instance, cooling flow and bearing pressurization. The air pressure needed may require extraction of bleed air mid-way through a centrifugal stage of a compressor. An aerodynamic design of the bleed geometry influences losses in the bleed system.

SUMMARY

In one aspect, there is provided a shroud configured to be disposed around an impeller of a centrifugal compressor, the shroud having a wall extending around a central axis of the centrifugal compressor, the wall having an inner face oriented toward a gaspath and an outer face oriented away from the gaspath, a slot extending all around the central axis and from the inner face to the outer face of the wall, bridges secured to the wall, the bridges circumferentially distributed around the central axis and spanning across the slot, the bridges extending from roots to tips, the tips of the bridges circumferentially offset from the roots relative to the central axis.

In another aspect, there is provided a shroud configured to be disposed around an impeller of a centrifugal compressor, comprising a wall extending around a central axis, the wall having an inner face oriented toward a gaspath and an outer face oriented away from the gaspath, the wall having two wall sections each extending around the central axis; a slot extending all around the central axis and located between the two wall sections; and bridges distributed around the central axis and secured to both of the two wall sections and spanning the slot, the two wall sections secured to one another via the bridges, the bridges being inclined to be substantially parallel to a direction of a flow circulating through the slot.

In yet another aspect, there is provided a method of bleeding air from a centrifugal compressor having an impeller rotating about a central axis and a shroud disposed around the impeller, comprising: receiving a flow of air via an inlet of a gaspath of the centrifugal compressor and compressing the received flow of air with blades of the impeller; allowing air to exit the gaspath via a slot extending through the shroud and all around the central axis; and guiding the air exiting the gaspath within conduits circumferentially distributed around the central axis, the conduits extending from the slot along a direction substantially parallel to the air circulating through the slot.

DESCRIPTION OF THE DRAWINGS

Reference is now made to the accompanying figures in which.

DETAILED DESCRIPTION

Figure 1:
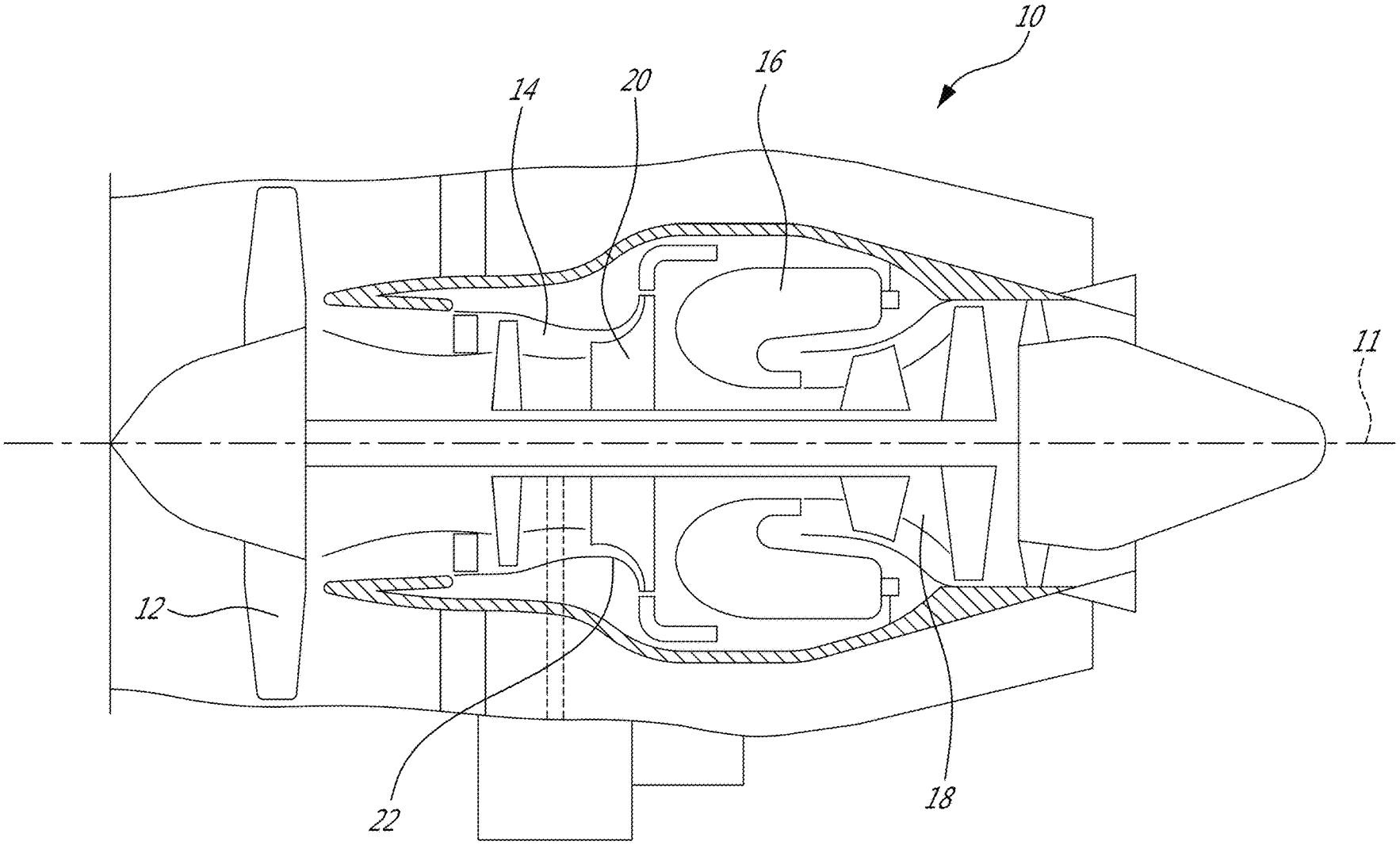
FIG. 1 is a schematic cross sectional view of a gas turbine engine.

FIG. 1 illustrates a gas turbine engine 10 of a type preferably provided for use in subsonic flight, generally comprising in serial flow communication a fan 12 through which ambient air is propelled, a compressor section 14 for pressurizing the air, a combustor 16 in which the compressed air is mixed with fuel and ignited for generating an annular stream of hot combustion gases, and a turbine section 18 for extracting energy from the combustion gases. The fan 12, the compressor section 14, and the turbine section 18 are rotatable about a central axis 11 of the gas turbine engine 10.

Figure 2:
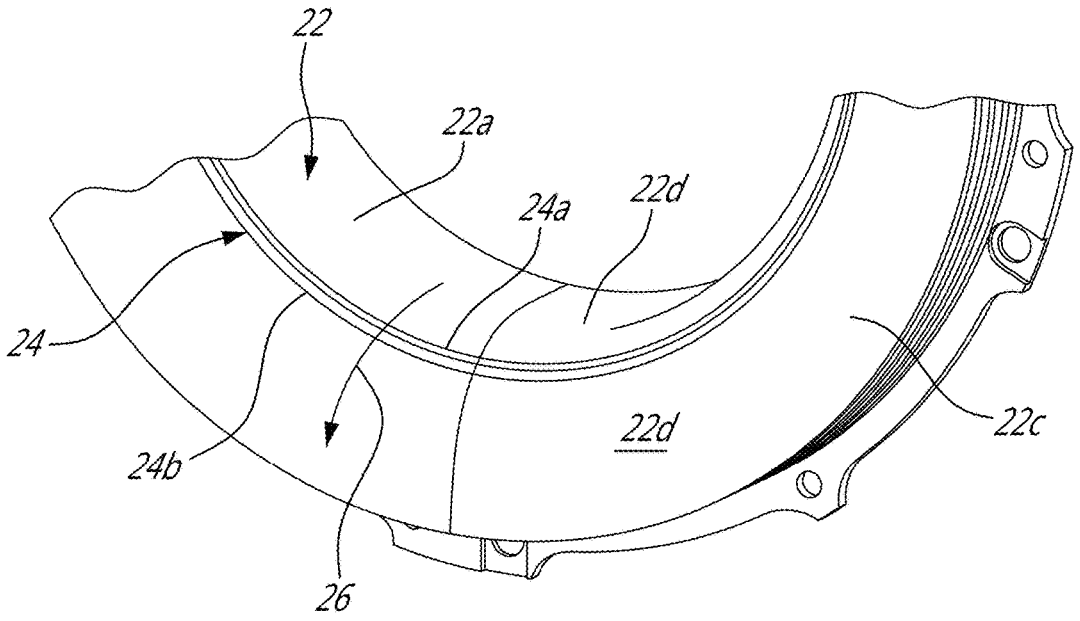
FIG. 2 is a schematic front fragmented three dimensional view of a shroud of an impeller in accordance with one embodiment.
Figure 3:
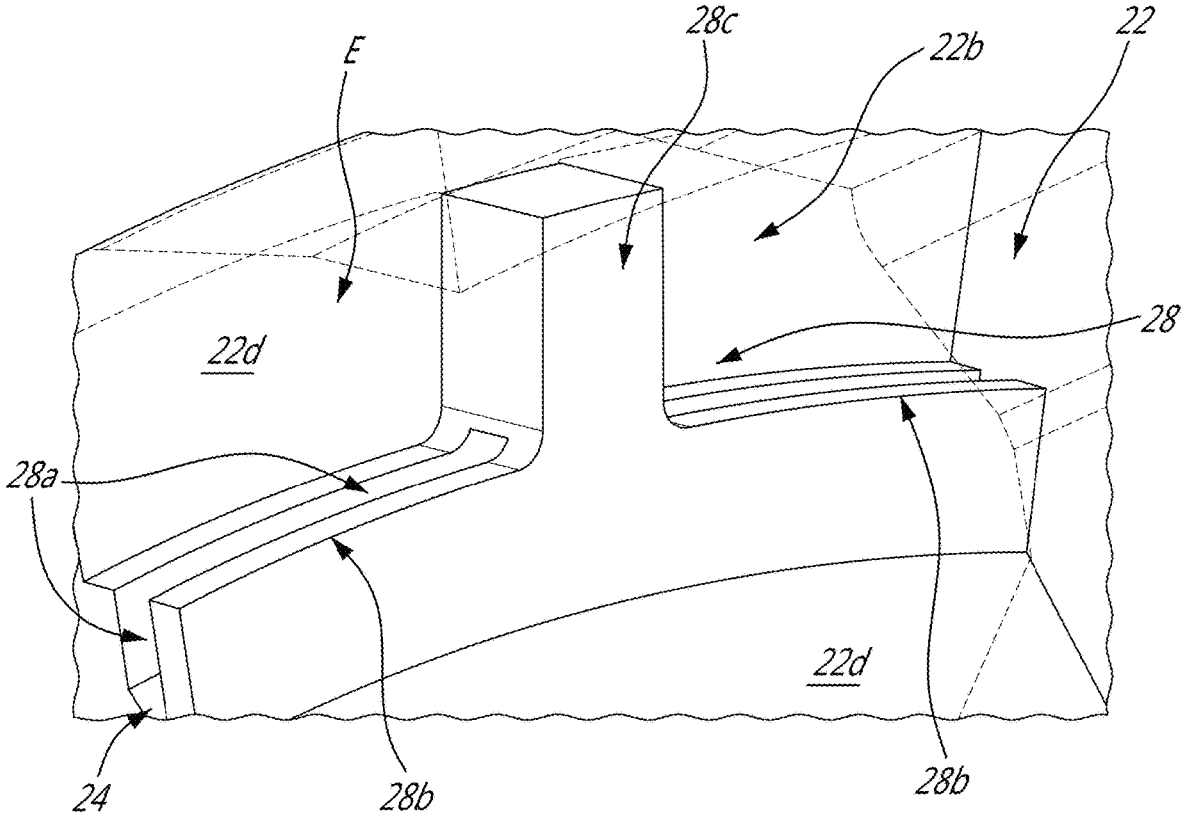
FIG. 3 is a schematic rear fragmented three dimensional view of the shroud of FIG. 2.

Referring to FIGS. 1-2, the compressor section 14 may include an impeller 20 surrounded by an impeller shroud referred to below as a shroud 22. The impeller 20 is configured to rotate about the central axis 11 of the engine 10 and the shroud 22 circumferentially extends all around the impeller 20. The shroud 22 is configured to follow a shape of the impeller 20 blade tip. That is, in the embodiment shown, the impeller 20 is a compressor impeller having an inlet oriented substantially in an axial direction relative to the central axis 11 and an outlet oriented substantially in a radial direction relative to the central axis 11. The impeller 20 has a hub from which blades protrude; the hub curving from being substantially axial at the inlet to being substantially radial at the outlet. The shroud 22 has an inner side, also referred to as an impeller side, or a gaspath side, 22*a* configured to be oriented toward the impeller 20 and an opposed outer side 22*b*, also referred to as the back side or the rear side (FIG. 3). The inner side 22*a* of the shroud 22 is configured to be located proximate tips of the blades and is used for containing a flow within flow channels defined between each two circumferentially adjacent ones of the blades and the hub.

In some cases, it may be required to extract compressed air from the compressor section 14 of the gas turbine engine 10 for operation of other components of the engine 10. For instance, compressed air may be required for pressurizing a cabin of an aircraft equipped with the gas turbine engine 10; for pressurizing bearing cavities containing bearings of the engine 10; for providing the compressed air as cooling air for cooling, for instance, components of the turbine section 18 of the engine; and so forth.

In the embodiment shown, the shroud 22 defines an aperture that fluidly connects the flow passages of the impeller 20 with another component in need of compressed air. Herein, the aperture is provided in the form of a slot or trench 24 that circumferentially extends all around the central axis 11. The slot 24 is located downstream of the inlet of the impeller 20 and upstream of the outlet of the impeller 20. The slot 24 may be located mid-way between the inlet and the outlet of the impeller 20. The slot 24 may be located anywhere between the inlet and the outlet of the impeller 20. A direction of a flow of air along the shroud 22 is depicted by arrow 26 in FIG. 2. Although not shown, a chamfer or fillet may be located either at a leading edge 24*a* of the slot 24 and/or at a trailing edge 24*b* of the slot 24. The slot 24 extends from the inner face 22*a* of the shroud 22 through a wall 22*c* of the shroud 22 and reaches the outer face 22*b* of the wall 22*c* of the shroud 22. As the slot 24 extends through the wall 22*c*, the shroud 22 may have two wall sections 22*d* that are separated from one another by the slot 24.

In the embodiment shown, a reinforcing member 28 is located on the outer side 22*b* of the shroud 22 and protrudes away therefrom. The reinforcing member 28 may be monolithic with the wall 22*c* of the shroud 22 and may be manufactured from a monolithic piece of material. The shroud and the reinforcing member 28 may be, for instance, co-molded or machined from a monolithic block of material. In the embodiment shown, the reinforcing member 28 extends circumferentially all around the central axis 11 of the gas turbine engine 10. The reinforcing member may be provided in the form of a rib having a substantially square or rectangular cross-section taken on a plane containing the central axis 11.

The slot 24 is formed in the impeller side surface 22*a* without fully penetrating the thickness of the reinforced section 28. A proper milling tool can be used to form the slot 24. After the slot 24 is formed through a portion of the reinforcing member 28, the shroud 22 can be milled with a milling tool which is adapted to route the reinforcing member 28 in spaced-apart sections 28*b* excavating material until the slot 24 is exposed, thus forming a through bore slot communicating across the wall of the shroud 22. The unmilled areas between the spaced-apart sections 28*b* form circumferentially spaced-apart structural bridges 28*c* in a rear portion of the slot 24 formed in the shroud whereby to maintain structural rigidity of the shroud 22. In the embodiment shown, the two wall sections 22*d* are secured to one another via the bridges 28*c*. The bridges 28*c* extend from the outer face 22*b* of the wall 22*c* on one side of the slot 24 to the outer face 22*b* of the wall 22*c* on the opposite side of the slot 24. With the embodiment as shown herein, there may be sixteen of these structural bridges 28*c* formed about the circumferential slot 24 in the outer face 22*b* of the shroud 22. More or less bridges 28*c* may be used without departing from the scope of the present disclosure. Slots 28*a* extend through the spaced-apart sections 28*b* of the reinforcing member 28.

The circumferential continuous slot 24 is in fluid communication with a bleed cavity, or an environment E, outside the gaspath and located behind the shroud 22; the bleed cavity E may be in fluid communication with a component in need of compressed air as described herein above.

In order to assist the extraction of bleed air from the pressurized gas path, a chamfer or fillet may be formed in the impeller shroud 22 at the leading edge 24*a* and/or trailing edge 24*b* of the slot 24. This chamfer or fillet may assist in directing bleed air from the pressurized gaspath by facilitating the entry of bleed airflow into the slot 24. The chamfer or fillet may facilitate curving of the bleed air into the slot 24. More detail about this configuration are presented in U.S. Pat. No. 8,490,408, the entire content of which is incorporated herein by reference.

In a particular embodiment, impact on rotor dynamics is considerably reduced since the bridge points are on the back side surface of the impeller shroud (i.e. a continuous slot is offered to the gaspath side of the impeller shroud, the bridge points are on the back side). The pressure recovery may be improved as compared with other configurations lacking the continuous slot 24. The slot 24 may contribute to reduce the air system requirement for higher pressure air (fewer losses) and may provide the compressor with better pressure ratio and efficiency.

However, aerodynamic losses may be imparted on the flow circulating through the slot 24 by the bridges 28*c* that extend substantially in the radial direction relative to the central axis 11. Indeed, a circumferential component relative to the central axis 11 may be imparted to the flow circulating in the flow passages defined by the blades of the impeller, which is rotating about the axis 11. When the flow enters the slot 24, it may have a circumferential component and losses may be imparted when said flow intersects the bridges 28*c* that are substantially radial.

Figure 4:
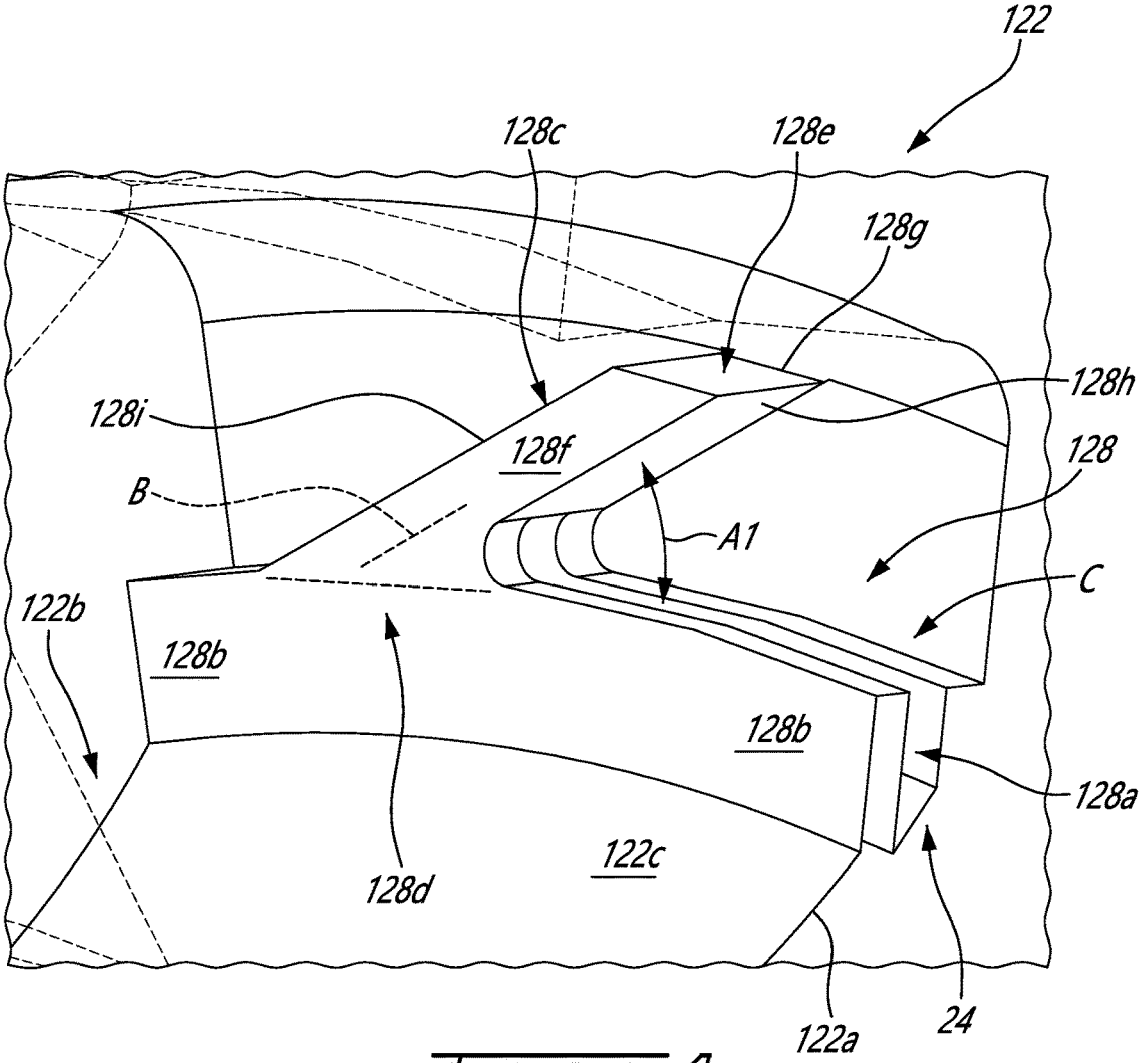
FIG. 4 is a schematic rear fragmented three dimensional view of a shroud in accordance with another embodiment that may be used with the impeller of the gas turbine engine of FIG. 1.
Figure 5:
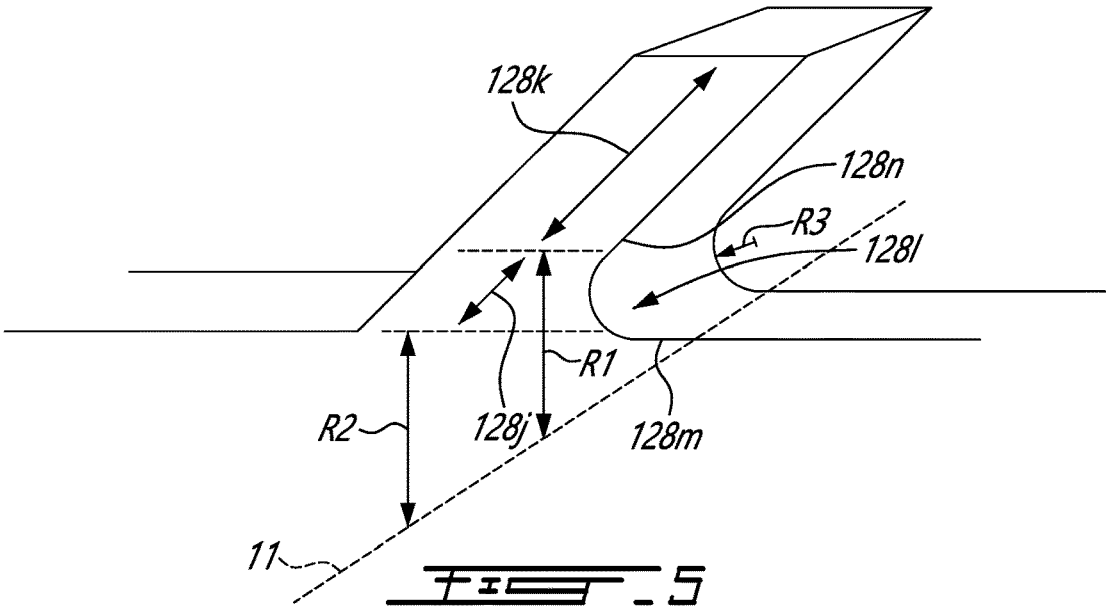
FIG. 5 is a schematic three dimensional view of one of structural bridges of the shroud of FIG. 4.

Referring now to FIGS. 4-5, a shroud in accordance with another embodiment that may be used with the impeller 20 is shown generally at 122. For the sake of conciseness, only elements that differ from the shroud 22 described above with reference to FIGS. 2-3 are described herein below.

The shroud 122 has a reinforcing member 128 circumferentially extending all around the central axis 11 of the engine 10 and is aligned with the slot 24. In the embodiment shown, bridges 128*c* are located between each two circumferentially adjacent ones of spaced apart sections 128*b*. As shown in FIG. 4, the bridges 128*c* extends both radially and circumferentially relative to the central axis 11 and away from the central axis 11. In other words, the bridges 128*c* are inclined. The bridges 128*c* have roots 128*d* and tips 128*e* radially spaced apart from the roots 128*d*. The tips 128*e* of the bridges 182*c* are circumferentially offset from the roots 128*d*. The bridges 128*c* may be inclined to be substantially parallel to a flow going through the aperture 24 and flowing in the cavity E.

The bridges 128*c* have a forward face 128*f*, an opposed rearward face 128*g*, a first lateral face 128*h* oriented partially in a circumferential direction, which corresponds to a direction of rotation of the impeller 20, and a second lateral face 128*i* opposite the first lateral face 128*g*. In the embodiment shown, the first and second lateral faces 128*h*, 128*i* are parallel. The first and second lateral faces 128*h*, 128*i* extend from the forward face 128*f* to the rearward face 128*g*. As the bridges 128*c* are inclined, the first lateral face 128*h* faces partially the outer face 122*b* of the wall 22. Conduits C are defined between each two adjacent ones of the bridges 128*c*, the conduits C extending away from the central axis 11 along a radial direction and a circumferential direction. The conduits C may be oriented parallel to a general direction of the flow exiting the gaspath via the slot 24. The bridges 128*c* are inclined in the direction of the impeller rotation.

In the embodiment shown, the bridges 128*c* extend at an angle A1 ranging from about 3 degrees to about 45 degrees. Herein, the expression "about" means that a value may range from plus or minus 10% of the value. For instance, about 45 degrees implies that the angle may be 45±4.5. In the embodiment shown, the angle A1 extends from the first lateral face to the spaced-apart sections 128*b*. The angle A1 may extend from the first lateral face 128*h* to the outer face 122*b* of the wall 122*c* of the shroud 122. In the embodiment shown, the angle A1 at which extends the bridges 128*c* remains constant along a bridge axis B from their roots 128*d* to their tips 128*e*. In a particular embodiment, the bridges 128*c* may curve between their roots 128*d* and their tips 128*e*.

Referring more particularly to FIG. 5, in the present embodiment, the bridges 128*c* have root sections 128*j* and tip sections 128*k*. The slot 24 extends through the root sections 128*j* and stops at radially inner ends of the tip sections 128*k*. In other words, the slot 24 does not extend through the tip sections 128*k*. Therefore, the two wall sections are secured to one another via the tip sections 128*k* of the bridges 128*c*. The root sections 128*j* extend from the roots 128*d* toward the tip sections 128*k* and the tip sections 128*k* extend from the tips 128*e* toward the root sections 128*j*. The root sections 128*j* create a transition between the spaced apart sections 128*b* and the tip sections 128*k*. In the embodiment shown, a width of the root sections 128*j* taken in the circumferential direction relative to the central axis 11, and extending from the first lateral face 128*h* to the second lateral face 128*j*, decreases from the roots to radially inner ends of the tip sections 128*k*. In the embodiment shown, the width of the tip section 128*k* is constant from the root section 128*j* to the tips 128*e*. In the depicted embodiment, cross-sectional areas of the tip sections 128*k* taken on planes normal to a radial direction relative to the central axis 11 are constant from the root sections 128*j* to the tips 128*e* of the bridges 128*c*.

In the depicted embodiment, the first lateral faces 128*h* of the bridges 128*c* define rounded section or fillets 1281 that connect with the spaced apart sections 128*b*. A radius of the rounded sections 128*l* may correspond to a radius of the milling tool used for creating the bridges 128*c*. In the embodiment shown, the rounded sections 128*l* are concave and extend from radially inner ends 128*m* to radially outer ends 128*n*. The radially inner ends 128*m* are located at the roots 128*d* of the bridges 128*c* and the radially outer ends 128*n* are located at the radially inner ends of the tip sections 128*k* of the bridges. In other words, the radially outer ends 128*n* of the rounded sections 128*l* are located at intersections between the root and tip sections 128*j*, 128*k*.

In the embodiment shown, the shroud 122 is manufactured according to the following equation:

$$R1 \geq R2 + R3 * (1 + \cos(A1))$$

Where R1 corresponds to a radial distance between the central axis 11 and the radially outer ends 128*n* of the rounded sections 128*l*; R2 corresponds to a radial distance between the central axis 11 and the radially inner ends 128*m* of the rounded sections 128*l*; R3 corresponds to the radius of the rounded section, or fillet, 1281; and A1 corresponds to the angle between the bridges 128*c* and the spaced apart sections 128*b* as described herein above. R1 may be referred to as the inner slot radius of the slot 128*a*; R2 as the outer milling cut lower radius; and R3 as the outer milling cut tool radius.

Figure 6:
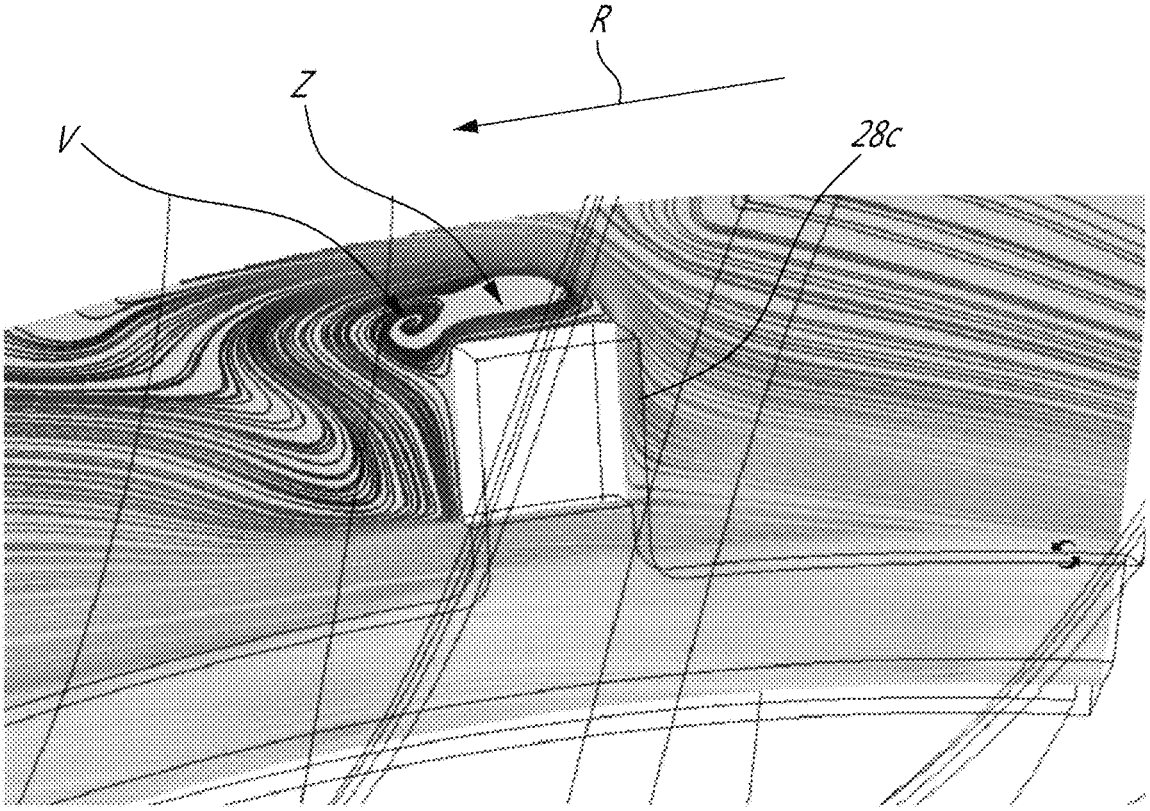
FIG. 6 are streamlines around the rear side of the shroud of FIG. 3.

Referring now to FIG. 6, streamlines of a flow circulating from the inner face 22*a* of the shroud 22 of FIGS. 2-3, through the slot 24, and within the cavity E delimited by the outer face 22*b* of the shroud 22 are shown. A direction of rotation of the impeller 20 is depicted by arrow R. As shown, a separation zone Z is present downstream of the bridges 28*c* and proximate the tips of the bridges. Moreover, a vortex V is created downstream of the separation zone Z. The separation zone Z and the vortex V create aerodynamic losses and decrease an efficiency of an extraction of the compressed air from within the flow passages of the impeller 20.

Figure 7:
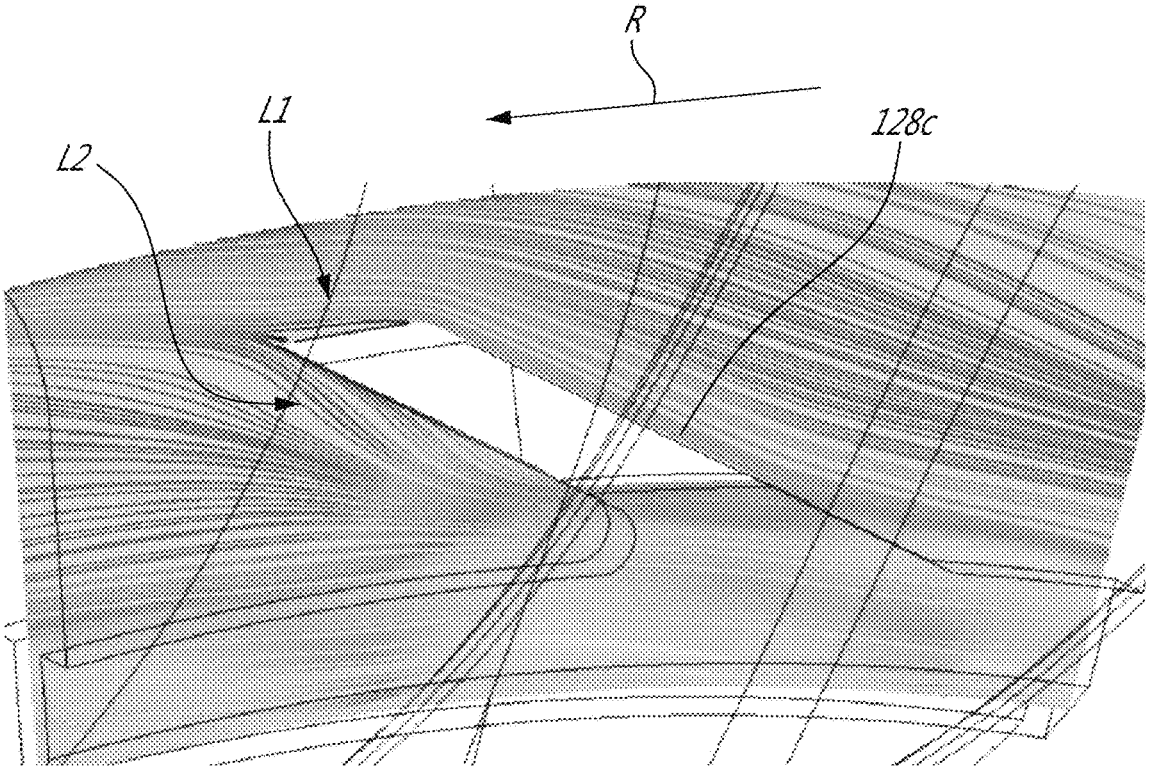
FIG. 7 are streamlines around the rear side of the shroud of FIG. 4.

Referring now to FIG. 7, streamlines of a flow circulating from the inner face 122*a* of the shroud 122 of FIGS. 4-5, through the slot 24, and within the cavity E delimited by the outer face 122*b* of the shroud 122 are shown. As shown at location L1, a size of the flow separation proximate the tips of the bridges 128*c* is greatly reduced compared to that of the shroud 22 shown in FIG. 6. Moreover, as shown at location L2, there is no vortex of the flow downstream of the bridges. Consequently, and in a particular embodiment, the efficiency of the shroud 122 described above with reference to FIGS. 4-5 is greater than that of the shroud 22 described above with reference to FIGS. 2-3. In a particular embodiment, the disclosed shroud 122 enhances performances of the bleed slot 24 by controlling the rear surface cut angle A1 and the radius between the gaspath-side cut and the rear surface cut. This may consequently reduce flow separation around the bridges and the pressure loss in the bleed cavity.

Referring back to FIGS. 4-5, for manufacturing the shroud 122, a body is provided; the body including the wall 122*c* and the reinforcing member 128 secured to the outer face 122*b* of the wall 122*c*. The reinforcing member 128 may, at this stage, extends radially from the outer face 122*b* of the wall 122*c* to the tips 128*e* of the bridges 128*c*, which are not defined yet, and may have a constant cross-section all around the central axis 11 (e.g., square, rectangular). A milling tool may be used to dig the slot 24. A dimension of the slot 24 along an axial direction relative to the central axis may correspond to a diameter of the milling tool. The slot 24 is created by rotating the shroud relative to the milling tool about the central axis 11. More than one pass may be required if the diameter of the milling tool is less than the desired axial dimension of the slot 24. A depth of the slot in a direction substantially radial relative to the central axis 11 is less than a radial distance between the wall and a radially outer end of the reinforcing member 128, which may correspond to the tips 128*e* of the bridges 128*c*.

Then, the milling tool may be rotated to be substantially parallel to the central axis 11. The bridges 128*c* and the spaced apart sections 128*b* may be created by removing matter along the angle A1 thereby creating the fillets 1281 on the concave side of the bridges 128*c*. This latter step may be repeated for each of the bridges 128*c*.

For bleeding air from the centrifugal compressor, a flow of air is received via an inlet of a gaspath of the centrifugal compressor and compressing the received flow of air with blades of the impeller; air is allowed to exit the gaspath via a slot extending through the shroud and all around the central axis; and the air exiting the gaspath is guided within conduits circumferentially distributed around the central axis, the conduits extending from the slot along a direction substantially parallel to the air circulating through the slot. In the embodiment shown, guiding the air within the conduits includes guiding the air within the conduits extending at an angle ranging from 3 degrees to 45 degrees.

Embodiments Disclosed Herein Include:

A. A shroud configured to be disposed around an impeller of a centrifugal compressor, the shroud having a wall extending around a central axis of the centrifugal compressor, the wall having an inner face oriented toward a gaspath and an outer face oriented away from the gaspath, a slot extending all around the central axis and from the inner face to the outer face of the wall, bridges secured to the wall, the bridges circumferentially distributed around the central axis and spanning across the slot, the bridges extending from roots to tips, the tips of the bridges circumferentially offset from the roots relative to the central axis.

B. A shroud configured to be disposed around an impeller of a centrifugal compressor, comprising a wall extending around a central axis, the wall having an inner face oriented toward a gaspath and an outer face oriented away from the gaspath, the wall having two wall sections each extending around the central axis; a slot extending all around the central axis and located between the two wall sections; and bridges distributed around the central axis and secured to both of the two wall sections and spanning the slot, the two wall sections secured to one another via the bridges, the bridges being inclined to be substantially parallel to a direction of a flow circulating through the slot.

Embodiments A and B may include any of the following elements, in any combinations:

Element 1: the bridges extend substantially parallel to a direction of an airflow received through the slot. Element 2: the bridges define an angle with the outer face of the wall ranging from 3 degrees to 45 degrees. Element 3: the angle extends from the wall to one of two lateral faces of the bridges that partially faces the wall. Element 4: further comprising a reinforcing member secured to the outer face of the wall and extending circumferentially all around the central axis, the slot extending through the reinforcing member, the bridges protruding from the reinforcing member. Element 5: the bridges have root sections and tip sections protruding from the root sections, the slot extending through root sections and ending at radially inner ends of the tip sections. Element 6: cross-sectional areas of the tip sections taken on planes normal to bridge axes are constant from radially inner ends of the tip sections to radially outer ends thereof. Element 7: the tip sections are connected to the root sections via fillets on lateral sides of the bridges oriented partially toward the outer face of the wall, and wherein R1≥R2+R3 *(1+cos (A1)) where R1 is a radial distance between the central axis and radially outer ends of the root sections, R2 is a radial distance between the central axis and radially inner ends of the root sections, R3 is the radius of the fillets, and A1 is an angle between the tip sections and the outer face of the wall. Element 8: further comprising a reinforcing member secured to the outer face of the wall and extending circumferentially all around the central axis, the slot extending through the reinforcing member, the bridges protruding from the reinforcing members. Element 9: the bridges extend from roots to tips, the tips circumferentially offset from the roots relative to the central axis.

The above description is meant to be exemplary only, and one skilled in the art will recognize that changes may be made to the embodiments described without departing from the scope of the invention disclosed. For example, although the disclosed shroud has been described as part of a radial or centrifugal compressor of a gas turbine engine, it may be used as part of a radial or centrifugal compressor of any other kind of engine and may be used in a turbocharger. Still other modifications which fall within the scope of the present invention will be apparent to those skilled in the art, in light of a review of this disclosure, and such modifications are intended to fall within the appended claims.

The invention claimed is:

1. A shroud configured to be disposed around an impeller of a centrifugal compressor, the shroud comprising a wall extending around a central axis of the centrifugal compressor, the wall having an inner face oriented toward a gaspath and an outer face oriented away from the gaspath, a slot extending all around the central axis and from the inner face to the outer face of the wall, and bridges secured to the wall, the bridges circumferentially distributed around the central axis and spanning across the slot, the bridges extending from roots to tips, the tips of the bridges circumferentially offset from the roots relative to the central axis, the bridges being inclined and having bridge axes extending along both of a radial direction and a circumferential direction relative to the central axis.

2. The shroud of claim 1, wherein the bridges extend substantially parallel to a direction of an airflow received through the slot.

3. The shroud of claim 1, wherein the bridges define an angle with the outer face of the wall ranging from 3 degrees to 45 degrees.

4. The shroud of claim 3, wherein the angle extends from the wall to one of two lateral faces of the bridges that partially faces the wall.

5. The shroud of claim 1, further comprising a reinforcing member secured to the outer face of the wall and extending circumferentially all around the central axis, the slot extending through the reinforcing member, the bridges protruding from the reinforcing member.

6. The shroud of claim 1, wherein the bridges have root sections and tip sections protruding from the root sections, the slot extending through root sections and ending at radially inner ends of the tip sections.

7. The shroud of claim 6, wherein cross-sectional areas of the tip sections taken on planes normal to the bridge axes are constant from radially inner ends of the tip sections to radially outer ends thereof.

8. The shroud of claim 6, wherein the tip sections are connected to the root sections via fillets on lateral sides of the bridges oriented partially toward the outer face of the wall, and wherein $$R1 \geq R2 + R3 * (1 + \cos(A1))$$

where R1 is a radial distance between the central axis and radially outer ends of the root sections, R2 is a radial distance between the central axis and radially inner ends of the root sections, R3 is the radius of the fillets, and A1 is an angle between the tip sections and the outer face of the wall.

9. The shroud of claim 8, further comprising a reinforcing member secured to the outer face of the wall and extending circumferentially all around the central axis, the slot extending through the reinforcing member, the bridges protruding from the reinforcing member.

10. A shroud configured to be disposed around an impeller of a centrifugal compressor, comprising a wall extending around a central axis, the wall having an inner face oriented toward a gaspath and an outer face oriented away from the gaspath, the wall having two wall sections each extending around the central axis; a slot extending all around the central axis and located between the two wall sections; and bridges distributed around the central axis and secured to both of the two wall sections and spanning the slot, the two wall sections secured to one another via the bridges, the bridges being inclined to be substantially parallel to a direction of a flow circulating through the slot.

11. The shroud of claim 10, wherein the bridges extend from roots to tips, the tips circumferentially offset from the roots relative to the central axis.

12. The shroud of claim 10, wherein the bridges define an angle with the outer face of the wall ranging from 3 degrees to 45 degrees.

13. The shroud of claim 12, wherein the angle extends from the wall to one of two lateral faces of the bridges that partially faces the wall.

14. The shroud of claim 10, further comprising a reinforcing member secured to the outer face of the wall and extending circumferentially all around the central axis, the slot extending through the reinforcing member, the bridges protruding from the reinforcing member.

15. The shroud of claim 10, wherein the bridges have root sections and tip sections protruding from the root sections, the slot extending through root sections and ending at radially inner ends of the tip sections.

16. The shroud of claim 15, wherein the tip sections are connected to the root sections via fillets on sides of the bridges oriented partially toward the outer face of the wall, and wherein $$R1 \geq R2 + R3 * (1 + \cos(A1))$$

where R1 is a radial distance between the central axis and radially outer ends of the root sections, R2 is a radial distance between the central axis and radially inner ends of the root sections, R3 is the radius of the fillets, and A1 is an angle between the bridges and the outer face of the wall.

17. The shroud of claim 16, further comprising a reinforcing member secured to the outer face of the wall and extending circumferentially all around the central axis, the slot extending through the reinforcing member, the bridges protruding from the reinforcing member.

18. The shroud of claim 15, wherein cross-sectional areas of the tip sections taken on planes normal to bridge axes are constant from radially inner ends of the tip sections to radially outer ends thereof.

19. A method of bleeding air from a centrifugal compressor having an impeller rotating about a central axis and a shroud disposed around the impeller, and bridges secured to a wall comprising: receiving a flow of aft via an inlet of a gaspath of the centrifugal compressor and compressing the received flow of air with blades of the impeller; allowing aft to exit the gaspath via a slot extending through the shroud and all around the central axis, and from an inner face to an outer face of the wall; and guiding the aft exiting the gaspath within conduits circumferentially distributed around the central axis, the conduits extending from the slot along a direction substantially parallel to the aft circulating through the slot, the conduits, defined between the bridges being inclined, to be substantially parallel to the aft circulating through the slot.

20. The method of claim 19, wherein guiding the air within the conduits includes guiding the air within the conduits extending at an angle ranging from 3 degrees to 45 degrees.

* * * * *